US005815836A

United States Patent [19]

Jacobson, II

[11] Patent Number: 5,815,836

[45] Date of Patent: Oct. 6, 1998

[54] METHOD AND APPARATUS FOR RESTRAINING A NECKTIE

[76] Inventor: Julius H. Jacobson, II, 1125 Fifth Ave., New York, N.Y. 10028

[21] Appl. No.: 853,503

[22] Filed: May 8, 1997

[51] Int. Cl.[6] ..... A41D 25/00

[52] U.S. Cl. ..... 2/145; 2/144; 2/300; 2/52

[58] Field of Search ..... 2/144, 145, 147, 2/149, 148, 52, 338, 174, 113, 114, 115, 105, 106, 150, 151, 152.1, 153, 154, 155, 156, 157, 304, 300, 323, 336, 330, 244

[56] References Cited

U.S. PATENT DOCUMENTS 2,652,569 9/1953 Confino ..... 2/145

*Primary Examiner*—Jeanette E. Chapman

*Attorney, Agent, or Firm*—Fulbright & Jaworski LLP

[57] ABSTRACT

A simple and effective apparatus for anchoring a tie to a wearer's shirt, which presents the best possible appearance at all times while keeping the tie clean, safe and out of harms way. In addition, the apparatus may be easily mounted on virtually any tie with minimal time and expense. The apparatus has two parallel rails attached to the back of a tie, which provide support for a horizonal collar with a slot. The horizonal collar is configured to travel along the vertical rails. An elongated member is adapted for vertical movement inside the slot of the horizonal collar. The elongated member may have button holes suitable for connection to a wearer's shirt.

10 Claims, 4 Drawing Sheets

METHOD AND APPARATUS FOR RESTRAINING A NECKTIE

BACKGROUND OF THE INVENTION

1. Field of the Invention

The present invention relates to an apparatus for restraining neckties and, more particularly, to an improved apparatus to anchor a necktie to a shirt so that it remains properly restrained and centered when adorned.

2. Description of the Prior Art

Neckwear is a common apparel accessory. The necktie has become a standard component of formal and business dress, and the necktie has even become popular as informal attire. Neckties are available in a variety of styles and colors, so a wearer may select a tie that complements his wardrobe.

A commonly preferred tie is the "four-in-hand" necktie. A conventional four-in-hand necktie is tied about the neck with a knot at a shirt collar and generally has an outward facing section passing down the shirt to conceal shirt buttons and a somewhat narrower tail section which hangs down from the knot and is concealed by the outward facing section. Normally, a wearer might use one of a number of possible methods to control a tie, including: letting both the outward section and the tail section hang free; passing the tail section through a manufacturer's label regularly provided on the back of the outward facing section so that the two sections hang as a unit; or attaching the two sections to the shirt by the use of various forms of jewelry, such as a tie-tack, a tie bar or a tie pin to keep the tie in place.

The extended portions of a necktie, the outward facing section and the narrower tail section, are not attached to the wearer below the knotted portion of the tie. Therefore, unless restrained in some way, the extended portions can be blown about by the wind or shifted by the movement of the wearer. As a result, the wearer fails to achieve his goal of a well-tailored look, and the wearer must continually adjust and reposition the tie.

The problem with the non-restrained methods of wearing a tie mentioned above is that the tie sections hang free. Therefore, the extended portions can be blown about by the wind or shifted by the movement of the wearer. As a result, the wearer fails to achieve his goal of a well-tailored look, and the wearer must continually adjust and reposition the tie. This not only causes a disarray in appearance, but the tie sections frequently interfere with the wear's work, or become soiled or ruined by dragging through food or other staining material, and may be quite hazardous if accidentally caught in a doorway or machinery.

Problems associated with the extending portions of a necktie are well recognized, and many attempts have been made to anchor the extending portions of a necktie to the wearer. However, prior attempts have failed to produce an inexpensive and easily installed anchoring device that will not damage the tie.

The best known anchoring devices are generally known as tie tacks, tie bars, tie chains and tie clips. These devices are frequently manufactured of polished metal and sold as jewelry. The use of jewelry holding devices is common, but also suffers from a number of drawbacks. First, these devices often pass in and out of favor depending on preference and fashion trends. Second, they are often expensive and regularly cause damage to the fabric by creating permanent holes, creases, and blemishes in the tie. Finally, these jewelry devices anchor the tie to the shirt and often do not permit vertical movement of the tie relative to the shirt.

Torso movements of the wearer cause the anchored tie to pull on the knot causing displacement of the knot and general disarray so as not to present an elegant appearance.

Not surprisingly, a number of solutions have been proposed to remedy the above problems, but none is believed to be wholly satisfactory. U.S. Pat. No. 4,920,579 to Swain describes an apparatus to restrain necktie tails of a four-in-hand tie at the front of the shirt by relying on the manufacturer's sewn-in-place label on the back of the outward facing section and a flat plastic loop threaded through that label and attached to buttons on the shirt front. The plastic loop is somewhat stiff and has button holes at each end with a fixed distance between them. This arrangement is believed to have numerous drawbacks, including its awkwardness to use requiring the wearer to keep track of the loop, re-position the loop each time a new tie is worn, and often requiring the wearer to re-knot of the tie to center the device properly. Further, this device relies on the distance between buttons fixed by the manufacturer of the shirt which is not always the same from shirt to shirt. Moreover, this device may cause tie damage through constant pulling on the manufacturer's label—a use for which the label is not designed. Finally, the stiff plastic loop may prove uncomfortable to wear.

SUMMARY OF THE INVENTION

The present invention provides a simple and effective means of constructing a secure anchor for a tie which presents the best possible appearance at all times while keeping the tie clean, safe and out of harms way. In addition, the apparatus of the present invention may be easily mounted on virtually any tie with minimal time and expense.

Another object of the apparatus is to maintain the tie tails of a four-in-hand tie in a generally straight line position down the front of a user's shirt while allowing only a relatively small lateral movement while the user undergoes movement from sitting, bending, standing or the like so as to prevent the development of forces tending to pull the tie tail and cause dislodgement of the tie knot.

It is another object of the present invention to provide an apparatus to hold a tie tail portion through the attachment of the apparatus to any two buttons which are normally covered by the tie tail when located in the desired position, such buttons being preselected to prevent pulling of the tie tail by the apparatus through embodiments.

It is a further object of the present invention to provide an apparatus for holding a tie tail of a four-in-hand neck tie in place while being completely hidden from view under normal movements by the user.

It is another object of the present invention to provide a tie-holding apparatus which embodies a design and construction of parts to permit permanent attachment to a necktie to avoid the loss of the apparatus.

It is a further object of the present invention to provide such an apparatus which can be easily and quickly installed on existing neckwear with minimal stress on the neckwear.

It is another object of the present invention to provide such an apparatus which is as inexpensive, simple and straightforward as possible to be readily adapted for full scale production.

It is yet another object of the present invention to provide such an apparatus which can be inexpensively adapted for use with pre-tied neckwear.

These features and advantages of the present invention will become evident from review of the following specification.

DETAILED DESCRIPTION OF THE INVENTION

The present invention is an improved apparatus and method for securing a necktie to a shirt to prevent it from being dislodged from a centered position.

As is known, a conventional four-in-hand tie is tied around the collar of a shirt and fashioned into a slip knot which is pulled snugly around a wearer's neck (not shown). It should be appreciated that the invention will function equally well with respect to "clip on" ties or similar devices which may not be tied in a traditional slip knot.

Once tied or applied, the tie generally leaves two sections hanging down from the knot, an outward facing section and a normally concealed tail section (not shown). As shown, the outward facing section (10) has a front (10A) and a back (10B).

Figure 1:
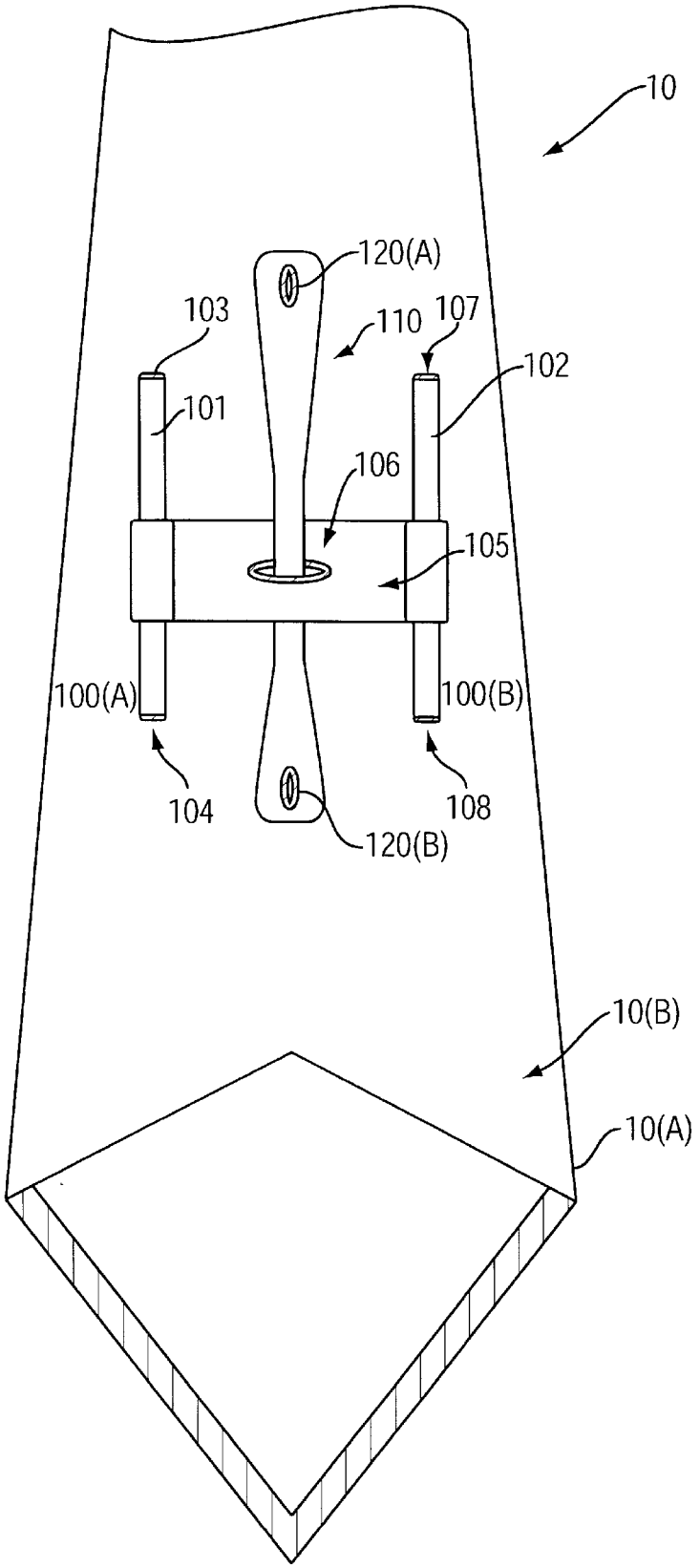
FIG. 1 shows a tie restraint.

Referring to FIG. 1, the apparatus includes two vertical rails 101, 102 that can be made of a variety of material (e.g., fabric, elastic, etc.). The ends 103, 104, 107 and 108 of the rails may be attached to the tie's back (10B). The vertical rails 101, 102 are usually parallel and the ends of the vertical rails 101, 102 can be attached by a variety of methods (e.g., sewn or glued).

Figure 2:
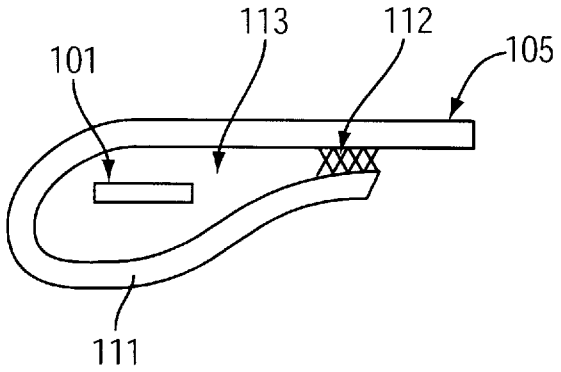
FIG. 2 shows the attachment of the horizonal collar.

A horizonal collar 105 is attached to the vertical rails 101, 102 in a way that allows it to travel longitudinally along the vertical rails 101, 102. The horizontal collar 105 can be made of fabric. Advantageously, it may be a modified designer label. Advantageously, the lateral ends of the horizontal collar each have a folded over section 111, attached to the collar by a restraining seam 112, to define a travel yoke 113 captivating a rail 101 as shown in FIG. 2. The horizonal collar 105 may have a slot 106, which could resemble a button hole, for providing support to an elongated restraining member 110. The restraining member 110 may advantageously be made of fabric. The slot 106 is large enough to allow longitudinal travel through the slot 106 by the elongated restraining member 110, but small enough not to allow the elongated restraining member to be removed. The elongated restraining member may have a narrow body with wide ends. The restraining member 110 and slot 106 may be of appropriate relative proportion to permit limited travel of the restraining member 110 through the slot 106 and prevent or limit the likelihood that the restraining member will inadvertently be removed from the slot or lost. The narrow relative size of the slot 106 inhibits removal of the elongated restraining member from the slot.

The ends 120(A) and 120(B) of the elongated restraining member 110 each have garment connector. The garment connectors may be button holes and advantageously are attached to shirt buttons to anchor the tie restraint to a wearer's shirt.

Since the horizontal collar can travel longitudinally along the vertical rails 101, 102, the need to retie the tie for aligning the elongated restraining member will be eliminated because the horizonal collar 105 can be adjusted to compensate when the garment connectors are not aligned with the buttons.

Figure 3:
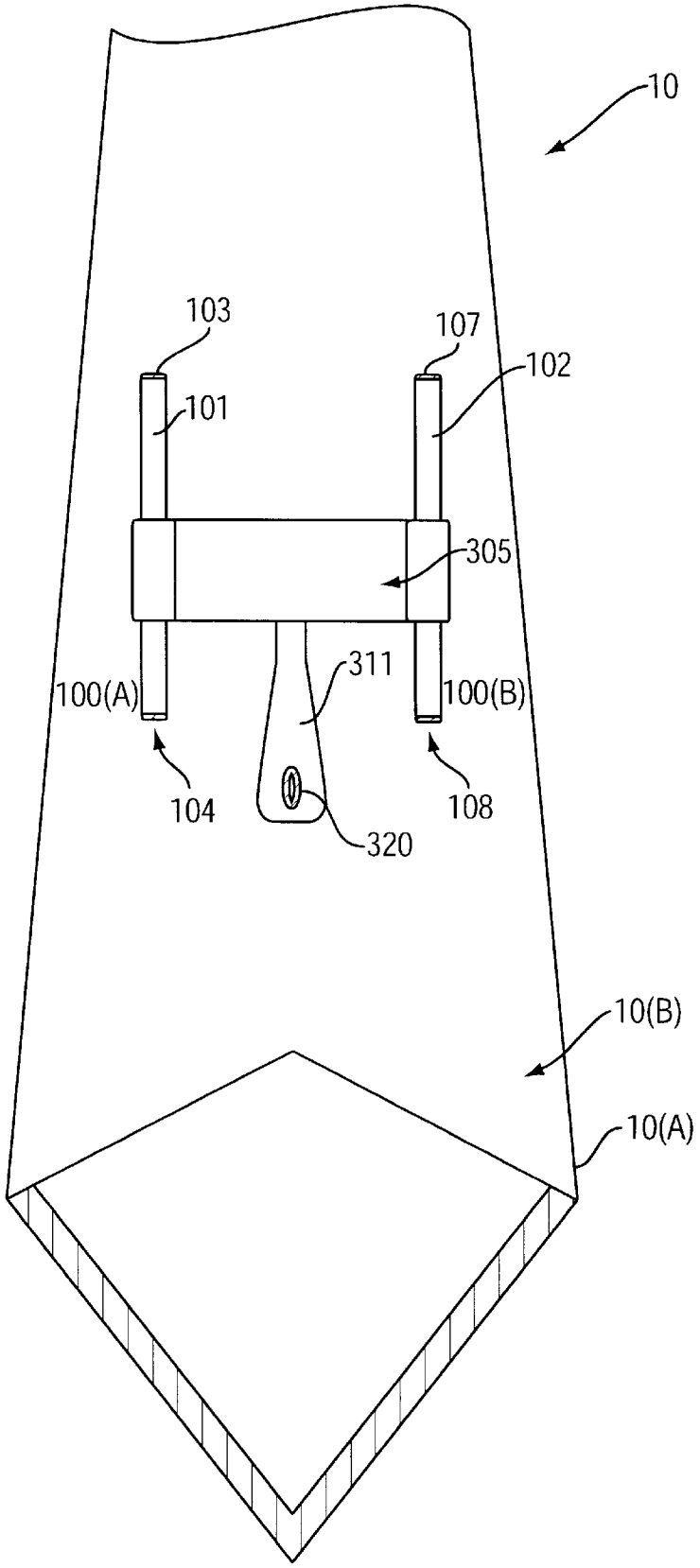
FIG. 3 shows an alternate tie restraint.
Figure 4:
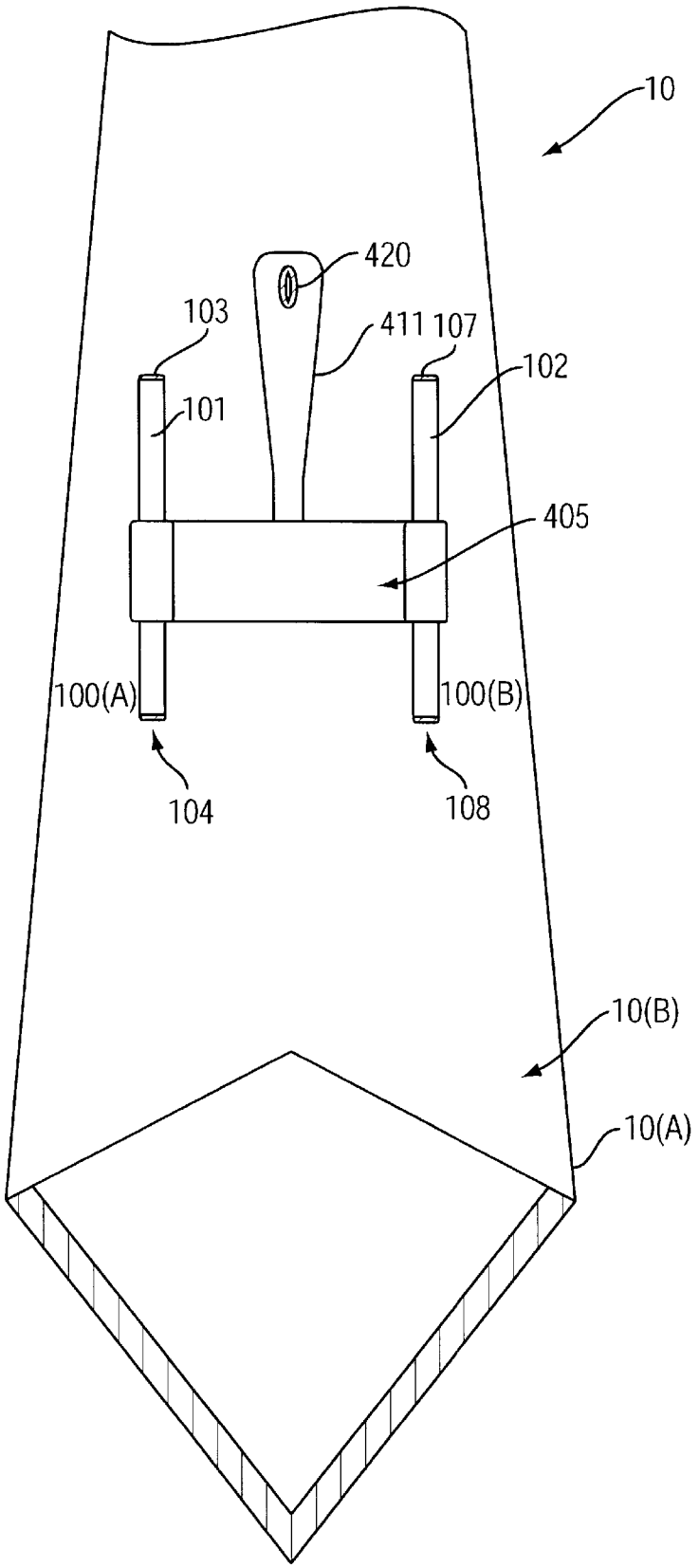
FIG. 4 shows an alternate tie restraint.

FIGS. 3 and 4 disclose alternate embodiments of the present invention. The concept is similar to the above disclosed embodiment. However, the elongated member is half the length. The horizonal collar 305, 405 slides along the vertical rail with a restraint member 311, 411 attached at the top or the bottom of the horizonal collar. The restraint has garment connectors, which may be button holes, for attachment to a wearer's shirt.

Since the horizontal collar can travel along the vertical rails 101, 102, the need to retie the tie for aligning the restraining member will be eliminated because the horizonal collar 305, 405 can be adjusted to compensate when the garment connectors are not aligned with the buttons.

I claim:

1. An apparatus for restraining a necktie comprising:

a first vertical rail and a second vertical rail attached to back side of a necktie;

a horizontal collar having a slot, a first end and a second end, where the first end is adapted to slide along the first vertical rail and the second end is adapted to slide along the second vertical rail;

an elongated member, located in the slot, having a first garment connector and a second garment connector.

2. An apparatus for restraining a necktie, according to claim 1, wherein said horizontal collar is slideably attached to said first vertical rail and said second vertical rail.

3. An apparatus for restraining a necktie, according to claim 1, wherein said elongated member can travel longitudinally through the slot of said horizontal member.

4. An apparatus for restraining a necktie, according to claim 1, wherein said elongated member has a midsection that has a width equal to or less than a width of the slot and sections above and below the midsection that are wider than the slot.

5. A method for restraining a necktie comprising:

securing a first vertical rail and a second vertical rail to a back side of a necktie;

securing a horizontal collar having a slot to said first vertical rail and second vertical rail;

threading the slot with an elongated member having a first garment connector and a second garment connector;

allowing longitudinal travel of said horizontal collar along said first vertical rail and said second vertical rail.

6. A method for restraining a necktie, according to claim 5, further comprising:

allowing longitudinal travel of said elongated member through the slot of the said horizontal collar.

7. A method for restraining a necktie, according to claim 5, further comprising:

attaching said first garment connector to a first button located on a shirt;

attaching said second garment connector to a second button located on a shirt.

8. A necktie comprising:

a first vertical rail and a second vertical rail;

a horizontal collar configured to travel along the first vertical rail and the second vertical rail, and the horizontal collar exhibits a slot;

an elongated member, located in the slot, having a first garment connector and a second garment connector.

9. An apparatus for restraining a necktie comprising:

a first vertical rail and a second vertical rail attached to back side of a necktie;

a horizontal collar having a first end and a second end, where the first end is adapted to slide along the first vertical rail and the second end is adapted to slide along the second vertical rail an elongated restraining member attached to the horizontal collar.

10. An apparatus for restraining a necktie, according to claim 9, further comprising:

paid elongated restraining member having a garment connector.

* * * * *